United States Patent [19]

Ciesmier

[11] 4,067,103

[45] Jan. 10, 1978

[54] METHOD OF MAKING A PLUG-IN FUSE

[75] Inventor: Allen L. Ciesmier, Palatine, Ill.

[73] Assignee: Littelfuse, Inc., Des Plaines, Ill.

[21] Appl. No.: 766,185

[22] Filed: Feb. 7, 1977

[51] Int. Cl.[2] ..... H01H 69/02

[52] U.S. Cl. ..... 29/623; 29/DIG. 12; 29/DIG. 15; 29/417; 113/116 P; 113/119; 337/198; 337/264; 337/295

[58] Field of Search ..... 29/DIG. 12, DIG. 15, 29/DIG. 26, 414, 417, 610 R, 623; 339/62, 147 P, 208; 337/198, 187, 201, 206, 255, 262–264, 293, 295, 297; 113/116 D, 116.4, 119

[56] References Cited

U.S. PATENT DOCUMENTS

| | | | |
|---|---|---|---|
| 1,777,916 | 10/1930 | Glossl | 29/623 X |
| 3,707,933 | 1/1973 | Berg | 113/119 X |
| 3,775,724 | 11/1973 | Mamrick | 337/245 |
| 3,909,767 | 9/1975 | Williamson et al. | 337/198 X |
| 3,962,782 | 6/1976 | Williamson et al. | 29/623 |
| 3,967,369 | 7/1976 | Takano | 113/119 X |
| 3,990,864 | 11/1976 | Rozmus | 113/119 X |
| 3,995,365 | 12/1976 | Repplinger | 113/119 X |
| 4,023,264 | 5/1977 | Schmidt, Jr. et al. | 29/623 |
| 4,023,265 | 5/1977 | Aryamane | 29/623 |

*Primary Examiner*—Victor A. DiPalma
*Attorney, Agent, or Firm*—Wallenstein, Spangenberg, Hattis & Strampel

[57] ABSTRACT

A method for making a plug-in fuse assembly like that disclosed and claimed in U.S. Pat. No. 3,909,767, granted Sept. 30, 1975 for Miniature Plug-In Fuse having different desired fuse ratings. The method comprises the steps of providing a strip of fuse metal which is initially preferably provided throughout its length with a continuous longitudinally extending portion of reduced thickness having a fixed thickness dimension and from which fuse link portions of fuse elements are to be stamped. Various selected areas of the strip, those which preferably are not the portions of reduced thickness and from which the terminal portions of the fuses are to be formed, are covered with a non-oxidizable conductive coating, preferably tin plating. The strip of fuse metal is then blanked to form longitudinally spaced still interconnected plug-in fuse element-forming sections each comprising spaced terminal blade portions and current-carrying extensions thereof formed from the thicker tin plated portions of the strip and a fuse link extending between said current-carrying extensions and formed from the unplated portions of the strip. The interconnecting un-plated fuse link portions of fixed reduced thickness dimension are arranged in desired locations and provided with desired configurations, including width and length dimensions, to provide the different desired fuse ratings. The method may include inserting over the end fuse-forming section of the strip either before or after it is severed from the strip a housing made of insulating material, with the current carrying extensions and the interconnecting fuse link portion of each plug-in fuse element within the housing and with the pair of terminal blade portions thereof extending outwardly from the housing.

16 Claims, 15 Drawing Figures

FIG. 5
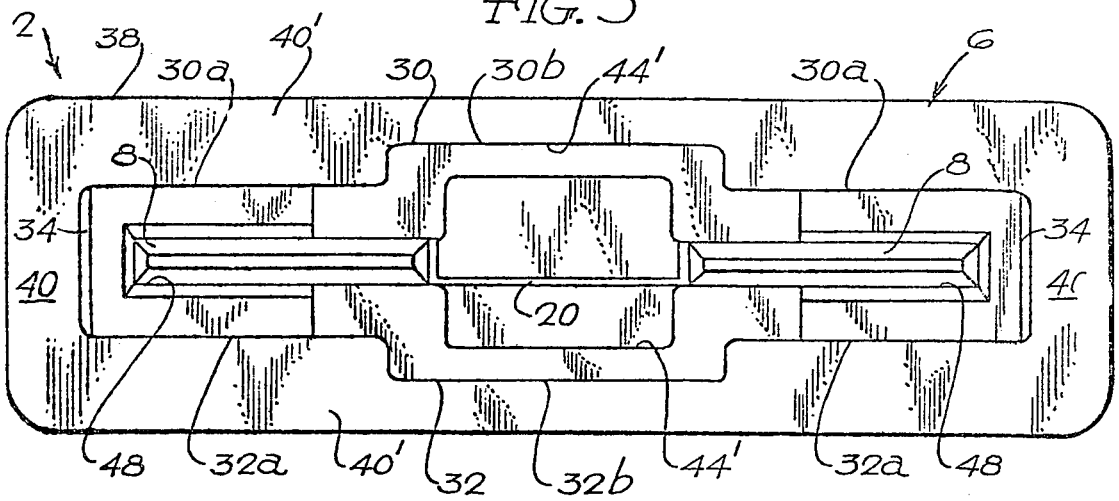
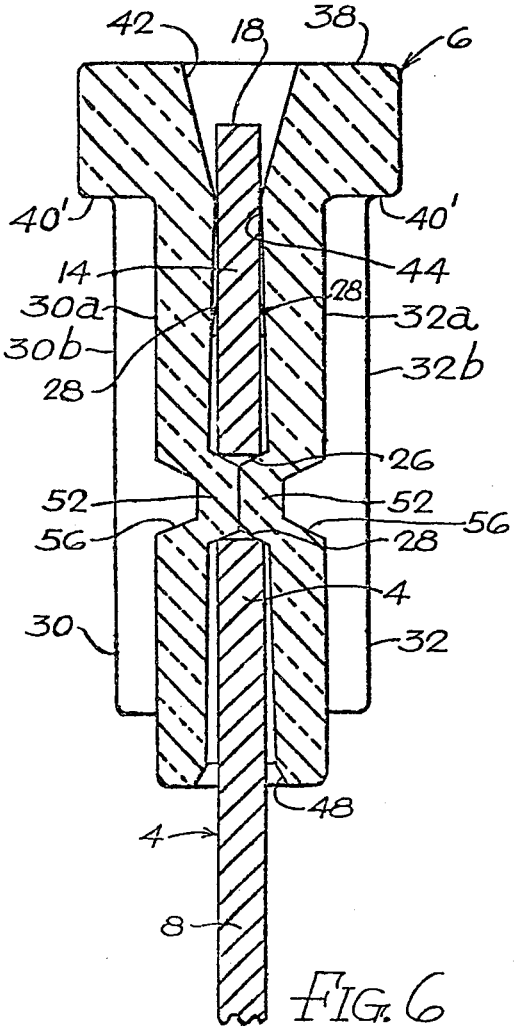
FIG. 6
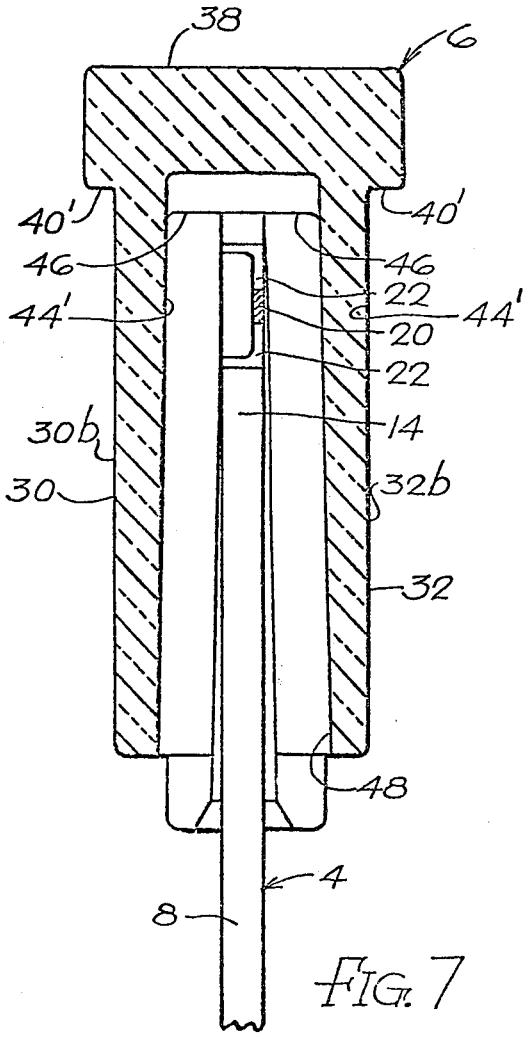
FIG. 7

METHOD OF MAKING A PLUG-IN FUSE

RELATED APPLICATIONS

This application is an improvement over the method of making fuses disclosed in U.S. Pat. Nos. 3,909,767, granted Sept. 30, 1975 and 3,962,782, granted June 15, 1976.

BACKGROUND OF THE INVENTION

Briefly, the most important application of this invention has to do with a method of making a plug-in fuse assembly like that disclosed in said U.S. Pat. Nos. 3,909,767 and 3,962,782, which preferably comprises a plug-in fuse element including a plate-like body of fuse metal having a pair of laterally spaced terminal blade portions to be received by pressure clip terminals in a mounting panel, current carrying extensions at the inner end portions of the pair of terminal blade-portions and a fuse link portion generally of reduced thickness and very small cross-sectional area interconnecting the current-carrying extensions.

Generally, the method of making such a plug-in fuse assembly disclosed in said U.S. patents comprises providing a blank of fuse metal which is blanked or stamped to provide the pair of laterally spaced terminal blade portions which, when the fuse link portion to be formed therefrom are very fragile, and interconnected by a transverse relatively rigid web. The exposed transverse web interconnecting the pair of terminal blade portions adds rigidity to the blank and securely maintains the relative positions of the pair of terminal blade portions, the current-carrying extensions and the fragile interconnecting link portion of reduced thickness, as a housing or the like is inserted over and secured to th blank. Thus, distortion, breakage or other damage to the blank is effectively prevented during these operations.

The housing is preferably inserted over the blank of fuse metal, preferably by way an of opening at the inwardly facing side of a one piece body of insulating material forming the housing, with the current-carrying extensions and the interconnecting fuse link portion of the blank preferably within the housing and with the pair of terminal blade portions of the blank, which are generally interconnected by the relatively rigid transverse web where the fuse link portion is fragile, extending outwardly from the housing preferably through the opening therein. The blank of fuse metal is suitably secured in the housing as by staking or the like. The housing is thus secured to the blank so that is acts as a rigid insulating body connected between the current-carrying extensions and/or terminal blade portions of the partially enclosed plug-in fuse element. While less desirable, the housing function for this body of insulating material can be eliminated so it acts only as a rigid support and, if desired, a convenient gripping surface for the plug-in fuse element. Where used, the exposed transverse web of fuse metal interconnecting the exposed terminal blade portions of the blank is then blanked or otherwise removed to complete the formation of a housed plug-in fuse element whose exposed pair of terminal blade portions may be insert-into metal sockets or the like of a terminal strip.

For maximum mass production efficiency of the housed plug-in fuse element just described, the blank of fuse metal from which each plug-in fuse element is formed is preferably part of a long strip of fuse metal upon which various blanking operations are performed as the strip moves past various stamping stations. The individual plug-in fuse elements are not completely separated from the strip until just before or after the housing is applied thereto at the end of the strip. The fuse link portions of the plug-in fuse elements are, as previously indicated, preferably of reduced thickness from that of the rest of the fuse-forming elements, and, in the case where the fuse elements are formed from a strip as just described, it is most convenient to provide the strip with a continuous band of reduced thickness extending parallel to the length of the strip, and preferably in the central portion thereof. As disclosed in copending application Ser. No. 698,072, filed June 21, 1976, on a Method of Making Miniature Plug-In Fuses of Different Fuse Ratings, plug-in fuse elements of different ratings are formed by varying the locations and/or configurations of the fuse-forming links stamped from the reduced portion of the strip.

One of the cost saving and size reducing aspects of the present method of making plug-in fuses just described is that each plug-in fuse element is a stamping made from a blank or strip of fuse metal, and a completely housed fuse results from merely enclosing the same in an insulating housing, so that the entire fuse assembly is formed of only two parts, and without any soldering operations required to connect a fuse link between the terminal portion of the fuse. However, the metal alloys constituting the fuse metal are readily oxidizable materials, and to insure a continuing low resistance contact between the terminal portions of the plug-in fuse elements are inserted, there should be an appreciable area of good electrical contact between the sockets and the exposed portions of the fuse metal, which is not possible if a thick oxidized film builds up on the surface of the terminal portions of the plug-in fuse element, particularly before it is inserted into the sockets. Oxidization of fuse metals can be prevented by applying a conductive coating over the fuse metal by plating techniques well known in the art. Tin coating is one common method of preventing oxidation of various metals. However, the electroplating of tin upon the exposed terminal-forming portions of the fuse-forming elements described can be a costly procedure because it must be selectively applied so that the fuse-forming link portions of the plug-in fuse elements are not similarly coated, since a tin coating thereon would undesirably modify the blowing characteristics of the fuse. For example, selectively coating the terminal portions of a plug-in fuse element by placing the fuse element in a suitable holder and immersing only the terminal portions thereof in an electro-plating tank would be a relatively costly procedure.

SUMMARY OF THE INVENTION

In accordance with the present invention, the aforesaid blank or strip of fuse metal from which the plug-in fuse elements are made is selectively provided with areas of tin plating or the like in the terminal-forming portions thereof, such plating being absent completely from the fuse link-forming portions thereof so that when the plug-in fuse elements are stamped from the blank or strip of fuse metal no electroplating operations of any kind have to be performed.

Where the plug-in fuse elements are successively formed in a strip of fuse metal as described, the selective application of tin plating over the fuse metal material is greatly facilitated. Thus, in the least preferred form of the present invention, the strip of fuse metal before it is fed through any die-stamping apparatus is moved through an electroplating cell which applies tin plating over the exposed surfaces thereof. The tin plating operation may be preceded by an identical copper plating operation or the like to prevent migration of the fuse metal through the tin plating coating. Prior to electroplating, the portions of the strip which are not to be machined and which are located in the areas thereof from which the fuse links are to be formed are covered by masking tape so that such areas remain unplated. However, the application and removal of masking tape from the strip unduly complicates the selective plating process. In accordance with one of the preferred aspects of the invention, the electroplating tank is provided with confronting pairs of fuse metal strip receiving bands between which the fuse link-forming portions of the fuse metal strip are closely received to isolate the same from the electrolyte of the electroplating tank, so that the strip of fuse metal leaving the electroplating tank has the desired plating selectively applied to the terminal-forming portions thereof which are to be protected from oxidation.

Where the fuse metal strip is to be provided with portions or bands of reduced thickness in those areas thereof from which the fuse links are to be formed, the least expensive method of selectively applying the plating thereto is initially to plate the entire surface area while it has an even thickness throughout, that is before any areas of reduced thickness are formed therein. Then, in the process of forming the portions of reduced thickness therein, as by a milling operation or the like, the plating thereon is automatically removed therefrom. While it has been heretofore preferred that the strip of fuse metal be reduced in thickness from only one side thereof to produce the desired thickness of metal, to remove the plating from both sides of the strip of fuse metal a very shallow groove of recess is preferably formed on one side of the strip of fuse metal only for the purpose of removing the plating thereon and a much deeper groove is formed in the other side for the purpose of reducing the strip to a desired thickness as well as removing the plating in the regions thereof from which the fuse link is to be formed.

The above and other features and other advantages of this invention will become apparent to those skilled in the art upon reference to the accompanying specification, claims and drawings.

DESCRIPTION OF THE DRAWINGS

FIG. 5 is an enlarged bottom view of the plug-in fuse assembly of FIG. 1;

FIG. 6 is an enlarged transverse vertical sectional view through the plug-in fuse assembly shown in FIG. 4, taken along section line 6—6 thereof;

FIG. 7 is an enlarged vertical transverse sectional view through the center portion of the plug-in fuse assembly shown in FIG. 4, taken along section line 7—7 thereof;

DESCRIPTION OF THE PREFERRED EMBODIMENT OF THE INVENTION

Referring now more particularly to FIGS. 1–4, there is shown in plug-in fuse assembly 2 to be made by the method of the invention illustrated in FIGS. 9–11 and 14–15 to be described. This assembly is made of only two component parts, namely a plug-in fuse element 4 which is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking and ultrasonic welding operation to be described.

Figure 1:
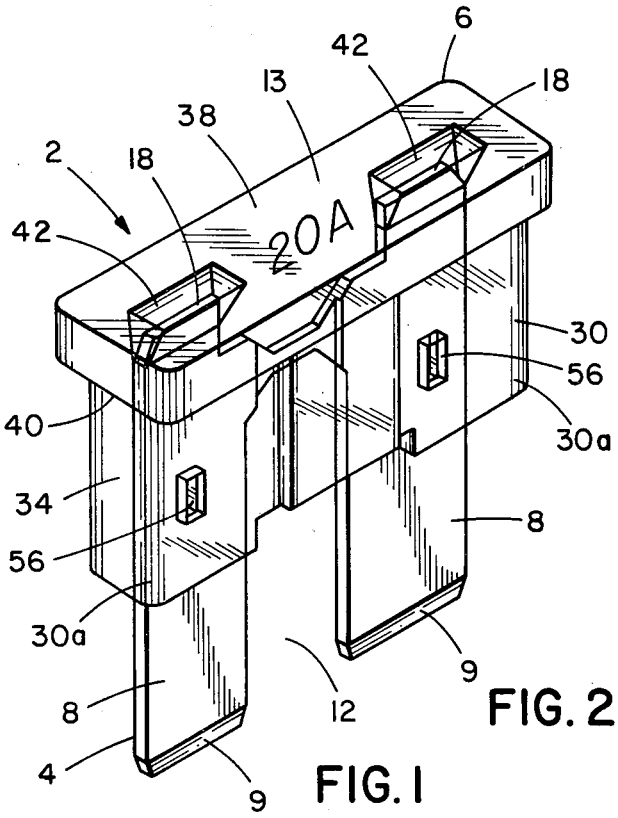
FIG. 1 is a perspective view of a preferred form of the plug-in fuse assembly made by the method of the invention.
Figure 2:
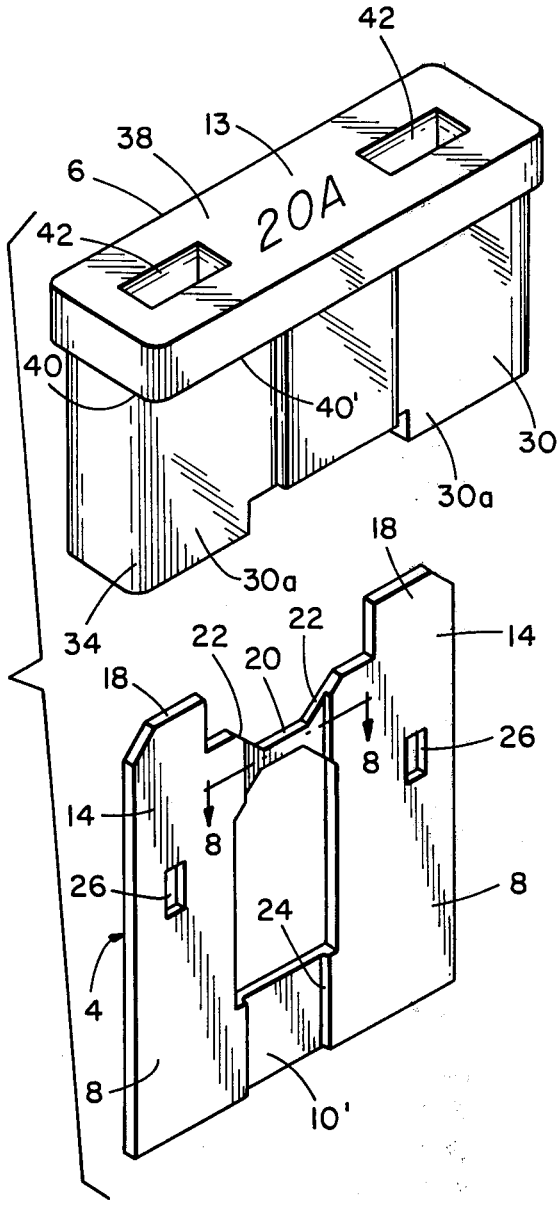
FIG. 2 is an exploded view of the housing and plug-in fuse element for making up the plug-in fuse assembly of FIG. 1.
Figure 3:
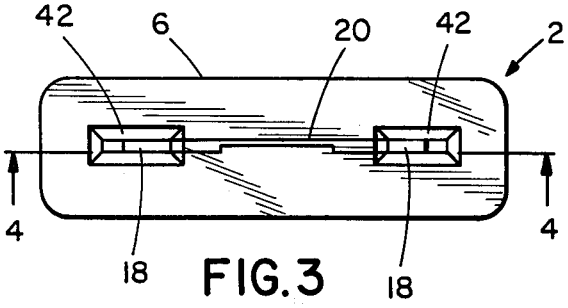
FIG. 3 is a top plan view of the plug-in fuse assembly of FIG. 1.
Figure 4:
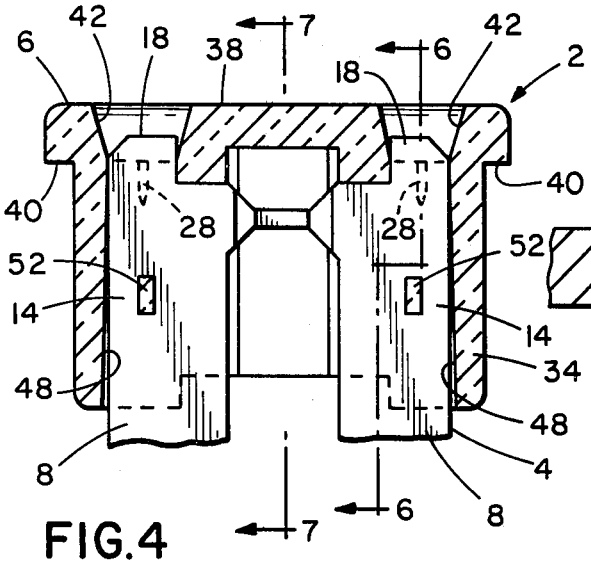
FIG. 4 is a vertical longitudinal sectional view through the plug-in fuse assembly shown in FIG. 3, taken along section line 4—4 therein.
Figure 8:
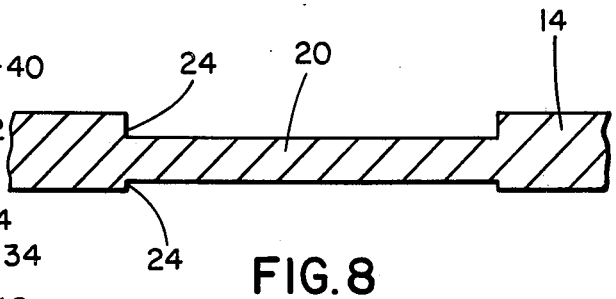
FIG. 8 is an enlarged fragmentary sectional view through the fuse link portion of the plug-in fuse element shown in FIG. 2, taken substantially along section line 8—8 therein, and showing the preferred manner in which the fuse link portion thereof is reduced in thickness.

The plug-in fuse element 4 has terminal blade portions 8—8 plated with a highly conductive metal like tin extending in spaced parallel relationship from the inner or bottom margin of the housing 6 in what will be referred to as a downward or inwardly extending direction. The ends of the terminal blade portions 8—8 of the plug-in fuse element, which are spaced apart as indicated at 12, are most advantageously tapered at 9—9 to form pointed end portions which readily slip into place between the confronting walls of conventional spring clip terminals (not shown) supported in mounting panel sockets. The current rating of the plug-in fuse assembly is indicated by indicia 13 on the outer wall of the housing as shown in FIGS. 1-2 and/or by a distinctive housing color.

Figure 12:
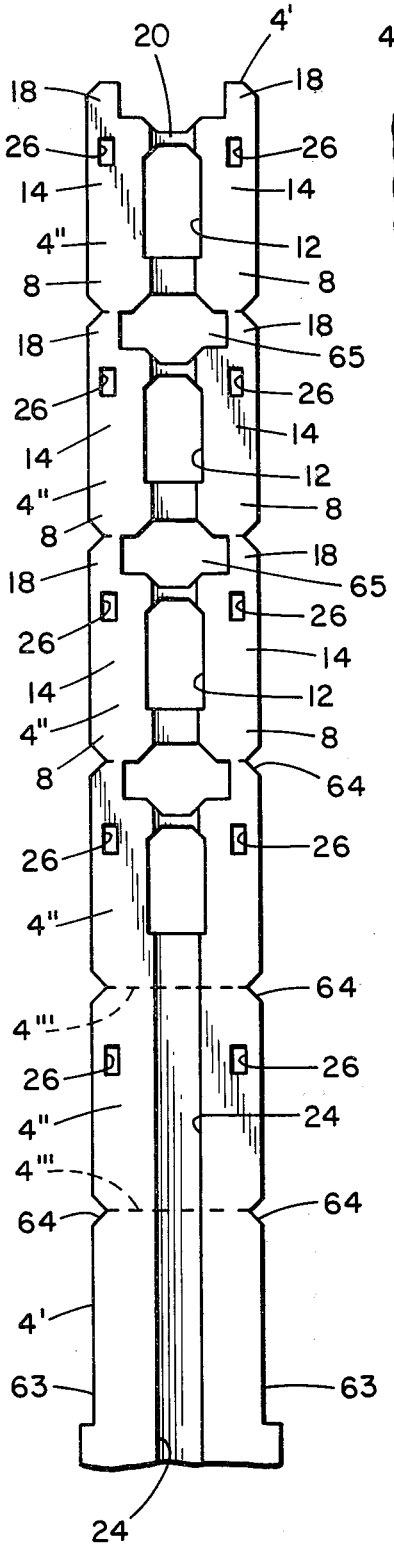
FIG. 12 illustrates the method of blanking the strip of fuse metal shown in FIG. 11, to provide plug-in fuse elements of the design shown in FIGS. 2 and 4.
Figure 9:
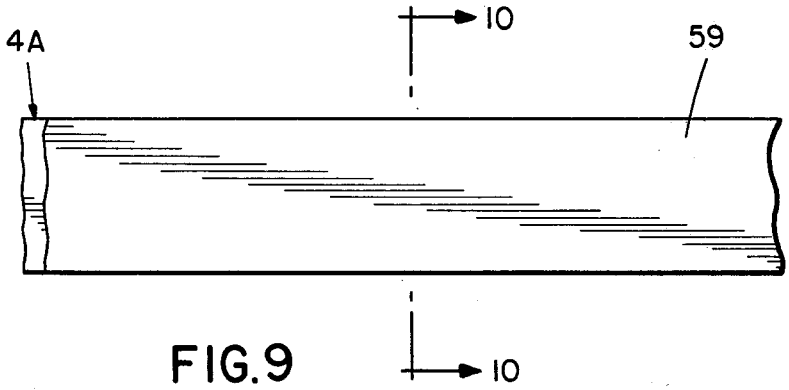
FIG. 9 is a top view of a strip of fuse metal from which fuse elements like that shown in FIGS. 1–8 are made and which has been plated over all of the surfaces with a suitable conductive coating prior to its being grooved and stamped to form a plurality of plug-in fuse elements.
Figure 10:
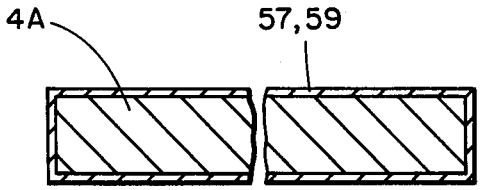
FIG. 10 is a sectional view through the plated strip of fuse metal shown in FIG. 9, taken along section line 10—10 therein.
Figure 11:
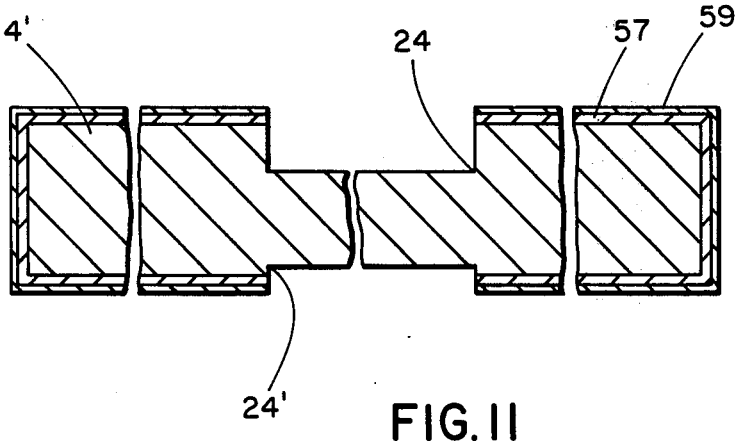
FIG. 11 illustrates the plated strip of fuse metal in FIG. 9 and 10 after it has been milled to form grooves in the opposite faces thereof in the fuse link-forming portions of the strip, to remove the plating material thereon and form areas of reduced thickness in the strip from which the fuse link portions of the fuse elements are formed.

The plug-in fuse element 4 may be formed from a partially tin plated strip 4' of fuse metal (FIGS. 11 and 12). Prior to the plug-in fuse element being severed from the strip 4', the terminal blade portions 8—8 may be interconnected to form a transverse rigidifying web 10' stamped from a reduced central portion of the strip. The stamping operation also forms the terminal blade portions 808 defined by a gap 12 between the same. The tapered portions 9—9 of the terminal blade portions 8—8 may be formed by coining dies (not shown) preferably after the operation which severs the plug-in fuse element from the strip.

The terminal blade portions 8—8 have current carrying extensions 14—14 which are preferably tin plated at least at the outer end portions thereof where, continuity checking probe-receiving tabs 18—18 are formed. The current-carrying extensions project into the aforementioned space formed by the housing 6 where they are contiguous to the front or outer wall of the housing to be described. The current-carrying extensions 14—14 are interconnected by an unplated fuse link portion 20 which is preferably both narrower in width and much smaller in thickness than the other current-carrying portions of the plug-in fuse element 4. However, especially large current rated fuses could have the same thickness as the other portion of the plug-in fuse element. The current-carrying capacity of the fuse link portion 20 may be varied by varying its location and its configuration including its width and length dimensions. In the particular configurations of the plug-in fuse element 4 shown in FIGS. 2 and 4 the current-carrying extensions 14—14 join the fuse-forming link portion 20 of the plug-in fuse element 4 by tapered portions 22—22. All of the various parts of the plug-in fuse element are shown substantially in coplanar relation.

The reduction of the thickness of the fuse metal of the fuse-forming link portion 20 is preferably achieved by initially providing in the strip 4' of fuse metal just before it is plated and, hence, the blanks 4'' of the strip, with a relatively deep groove 24 on one face thereof preferably extending longitudinally centrally throughout the strip 4', as shown in FIG. 11, to provide a longitudinally extending central portion of substantially reduced thickness in the strip 4' and the blanks 4'' thereof.

A shallow groove 24' is formed in the opposite face of the fuse metal strip for reasons to be explained. Different desired fuse ratings of the plug-in fuse assembly are determined by the composition of the fuse metal in the strip 4 of fuse metal, the thickness dimension of the fuse link portion 20, the location of the fuse link portion 20, and the configuration of the fuse forming link portion 20 including width and length dimensions. The composition of the fuse metal and the thickness dimensions of the fuse link portion 20 may be fixed parameters for making fuse elements having a number of different fuse ratings. The different desired fuse ratings are then obtained by selectively arranging the fuse link portions 20 of fixed reduced thickness dimension in desired locations and by selectively providing the fuse link portions 20 with desired configurations including width and length dimensions.

While the fuse metal strip may have a variety of compositions, one exemplary series of compositions in weight percentage is the following: 0.50–0.70% Cu; 0.12–0.18% Ti; a maximum of 0.07% Pb, 0.01% Cd, 0.01% Fe, 0.02% Cr; and the balance Zn. The strip of fuse metal as shown may have any desired maximum thickness as, for example, 0.025 inches thick. The shallow groove 24' is preferably no greater than about 0.003 inches and preferably only about 0.001 inches so that no special die wall projections need to be made to match and support this side of the strip to ensure precise stamping of the fuse link with a cutting die brought against the strip from the side thereof having a relatively deep groove 24. The deep groove 24, will generally be many times, such as 4 or more times deeper than the shallow groove, as for example 0.013 inches. A wide range of fuse ratings may, as a practical matter, require two or three different reduced thicknesses in the fuse metal strip, but one or more of these strips are desirably used to form fuses of many different ratings. There may be also further fixed dimensions which are also present in the plug-in fuse elements regardless of the fuse ratings thereof including the length and the width dimensions of the plug-in fuse elements, and the dimensions of the extensions 14, and the dimensions of the apertures 26.

While the plug-in fuse element 4 of such a high rating that the fuse link portion thereof is not fragile may be used as a fuse element without its incorporation in a housing or attachment to another body of insulating material acting only as a support structure for the terminal blade portions of the fuse element, for safety and other reasons it is preferred to incorporate the plug-in fuse element 4 in the housing 6. To this end, and to anchor the plug-in fuse element 4 within the housing 6, anchoring apertures 26—26 are formed in the terminal extensions 14—14 to receive anchoring projections to be described formed in the housing walls.

While the housing 6 could be made in two separate parts snappable or otherwise secured together, the housing is most advantageously a single piece molded part as previously indicated. Also, it preferably has a narrow elongated configuration formed by relatively closely spaced walls generally indicated by reference numeral 30–32, the side walls having end portions **30*a*–32*a* which are spaced together much more closely than the central or intermediate portions 30*b*–32*b* thereof. The side walls 30–32 are interconnected at their end margins by narrow end walls 34—34, and at their outer or top margins by an outer wall 38 which overhangs the rest of the housing to form downwardly facing shoulders 40—40 at the longitudinal ends of the outer wall 38 and downwardly facing shoulders 40'—40' along the longitudinal side margins of the housing 6. The shoulders 40'—40' are coplanar continuations of the shoulders 40—40 at the ends of the housing 6**.

Terminal access openings 42—42 are provided in the outer wall 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test probes can be guided into contact with the tabs 18—18. The terminal access openings 42—42 communicate with the aforementioned plug-in fuse element receiving space in the housing 4. The portions 44—44 of this space immediately beneath the access openings 42—42 are relatively small because of the close spacing of the side wall portions 30a–32a of the housing at these points, the width of the space portion 44—44 as viewed in FIG. 6 tapering from the bottom open end of the housing upwardly toward the terminal access openings 42—42, reaching a narrow dimension about equal to the thickness of the plug-in fuse element 4. The space portions 44—44 are provided on opposite sides thereof with small inwardly directed ribs 28 for engaging and centering the upper portions of the plug-in fuse element 4 in the housing 6. At the inner margins of the terminal access openings 42—42 the upper wall 38 is provided with downwardly extending skirts 46 —46 which act as shield walls preventing spewing fuse metal from gaining entrance to the terminal access openings 42—42. These shield forming skirts 46—46 also act as stop or abutment shoulders for the current-carrying extensions 14—14 of the terminal-forming blade portions 8—8 of the plug-in fuse element.

The fuse link portion 20 of the fuse element 4 is positioned in a relatively wide portion 44' (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44' of the space within the housing 6 open onto the bottom of the housing for the full extent thereof through an entry opening 48. The opening 48 permits the housing to be pushed over the end portion of end blank of the prestamped and milled strip 4' from which a completed fuse element is punched and immediately following the housing 6 is secured to the end portion or end blank of the strip as previously indicated.

The housing 6 is preferably a molded part made of a transparent syenthetic plastic material so that the fuse-forming filament portion 20 of the plug-in fuse element 4 is readily visible through the intermediate portion of the outer wall 38, to which the fuse-forming link portion 20 is in spaced but relatively contiguous relation. The housing may be molded of a high temperature material sold by Union Carbide under the trademark "POLYSULFONE" and order No. P1700, Natural 11.

While the housing interior could be made with resilient projections which snap into the anchoring apertures or openings 26—26 in the plug-in fuse element 4, it is preferred to secure the housing in place by forming projections 52 from both sides of the housing 6 by a cold staking operation, which enter the anchoring apertures 26—26 of the plug-in fuse element 4. The inwardly extending projections 52 are formed by the cold staking operation where they engage each other in the anchoring apertures or openings 26 are preferably welded together by ultrasonic welding or the like to provide a rigid anchoring structure. The depressions 56 left by the staking operation are shown in the side wall 30 in FIGS. 1 and 6.

The exemplary embodiments of the fuse assemblies described have thus provided exceedingly reliable, compact and inexpensive plug-in fuse assemblies which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse-forming link portion of the plug-in fuse element can be viewed when the plug-in fuse assembly is mounting on the mounting panel. The terminal access openings enable test equipment to test the continuity of the fuse if the user does not desire to rely solely on a visual observation of the fuse-forming link portion of the fuse.

The preferred method of making the plug-in fuse assemblies is illustrated in FIGS. 9–12. Before the strip 4' is grooved, it preferably is a fuse metal body 4A (FIGS. 9 and 10) of the same thickness throughout. In accordance with the preferred method of fabricating the strip shown in FIGS. 9–11, the fuse metal strip is initially plated throughout with a conductive coating which does not oxidize in the surrounding air. Where tin is selected as this conductive coating, to prevent bleeding of the fuse metal through the tin coating an initial coating of copper 57 is most advantageously plated on all exposed surfaces of the ungrooved strip following which tin 59 is similarly plated thereon. For example, the copper plating 57 is preferably between 0.00005 and 0.0001 inches and the tin plating is preferably between 0.00015 and 0.0002 inches thick. These coatings may be applied by electroplating these metals on the surface of the ungrooved strip. The plated strip 4A is formed into the grooved strip 4' by skiving or otherwise forming the aforementioned shallow groove 24' to a precise depth throughout the length of one face of the strip 4A and milling or otherwise forming the relatively deep groove 24 of somewhat less depth than the ultimately desired depth throughout the length of the other face of the strip involved. The milled groove 24 is than skived or otherwise machined to a precise depth to form a fuse link-forming strip portion of precise reduced thickness.

The grooved strip of fuse metal is advanced in any desired manner to various stamping dies which may be in a horizontal plate with the shallow groove 24 on the bottom side of the strip 4'. At each die stamping station the strip 4' is supported by a flat bottom stationary die surface (not shown) which may have a flat planar surface, except in those areas thereof which are to be removed from the strip.

Figure 13:
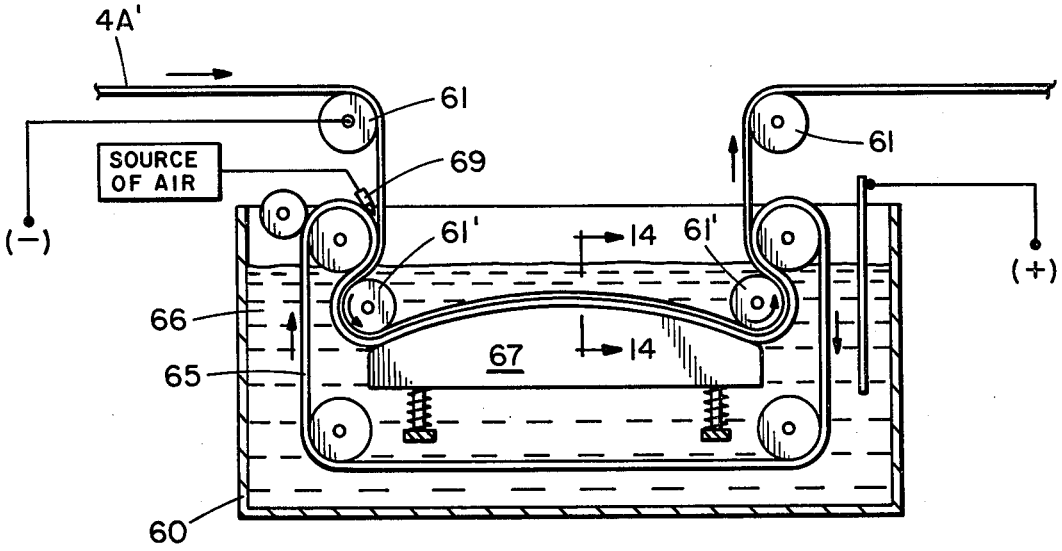
FIG. 13 illustrates an electroplating tank for performing the first step in an alternative method of the present invention where the strip of fuse metal is initially selectively plated with a suitable conductive coating in areas of the strip other than the fuse link-forming portions thereof.
Figure 14:
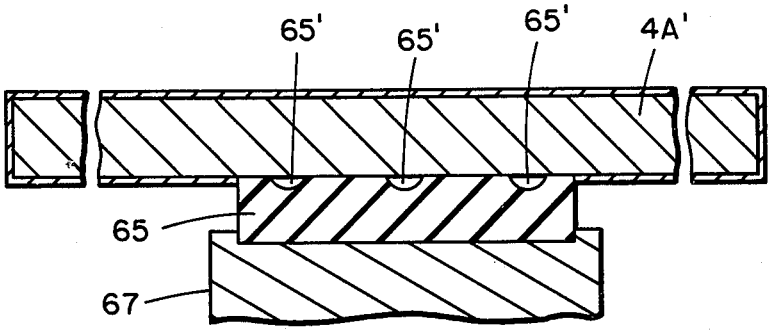
FIG. 14 is a sectional view through the fuse metal strip and electrolyte isolating band shown in FIG. 13, taken along section line 14—14 therein.
Figure 15:
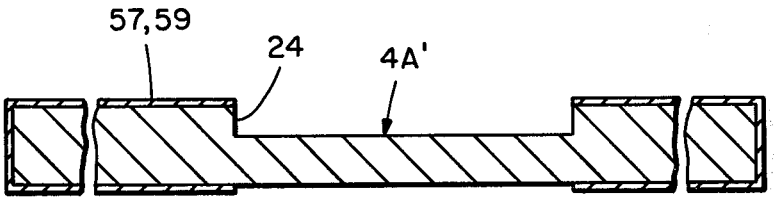
FIG. 15 is a sectional view through the plated strip of fuse metal shown in FIG. 14 after it has been milled and skived to form a groove in the face of the strip opposite to that against which the electrolyte isolating band shown in FIGS. 13 and 14 was applied, to remove the plating material thereon and to form areas of precisely reduced thickness in the strip from which the fuse link portions of the fuse elements are formed.

The provision of the conductive coatings on select areas of the strip 41 may less desirably be achieved by the method shown in FIGS. 13–16 wherein only selected areas of the strip 4A' of fuse metal shown are plated with copper and tin, or other suitable conductive non-oxidizing coating, by the provision of a special electrolyte isolating band 65 of rubber or a soft resilient synthetic plastic material which is applied against the fuse link-forming portion of the strip in the copper and tin electroplating tanks, one such tank 60 being shown in FIG. 13. If the plug-in fuse elements to be made from the strip 4A' are to be of such a high current rating that it is unnecessary to reduce the thickness thereof in the areas where the fuse link portions of the fuse elements are to be formed, then two such isolating bands would be used on opposite sides of the strip to isolate both sides thereof from the electrolyte. However, as illustrated in FIGS. 13 and 14, only one such band is applied to the strip 4A' so that the strip 4A' leaving the tank 60 will have a copper or tin plating thereon over all areas except the area of the strip engaged by the isolating band 65. This area is a continuous area or band opposite the center portion of the strip where the fuse link portions of the plug-in fuse elements are to be formed. The isolating band 65, therefore, makes unnecessary the formation of a shallow groove 24' like that described in the form of the invention illustrated in FIGS. 10 and 11.

In the common situation where the fuse link portions of the plug-in fuse elements have a reduced thickness, then the tin or copper thereat will be removed in the process of forming a deep groove 24 (FIG. 15) following the completion of the copper and tin plating operations.

As shown in FIG. 13, the strip 4A' is guided by roller means 62 positioned outside of the electrolyte 66 and roller means 62' located within the electrolyte in the tank and is advanced along the path determined by these roller means at a speech which will cause the proper amount of copper and tin to be plated on the strip. An electrode 68 of tin or copper is immersed in the electrolyte 66 and connected to the positive terminal of the source DC voltage.

The isolating band 65 is an endless band caused to follow a path within the tank 60 by roller means 61 located above the level of the electrolyte 66 and roller means 61' within the electrolyte. The band 65 is moved at the same speed as the speed of movement of the strip 4A', so that there is little or no frictional drag upon the strip 4A' which could tear or damage the same. The upper section of the band 65 follows the path of the central section of the strip 4A' and is urged against the bottom surface of the same by the tension in the band and also by the force of a pressure plate 67 spring-urged upwardly against the bottom of the band 65.

In the case of copper plating particularly, the exclusion of electrolyte from the space between the band 65 and the strip 4A' is best achieved by forming a cushion of air in this space which provides a positive pressure preventing the entry of electrolyte therein. Acccordingly, the surface of the band 65 which faces the strip 4A'may be provided with air-receiving slots 65' into which is directed air under pressure by air jet nozzles 69.

The advancing strip 4' of fuse metal may be first edge stamped as indicated at 63, to provide accurate width dimensions to the strip 4' and the blanks 4'' formed therein. The strip may also be provided with notches 64 in the edges thereof at the end margins 4'' of the blanks 4'' subsequently to form edge tapers on the blade portions 8. Next, the interlock openings 26 are blanked in the strip. Following this, the advancing strip 4' of fuse metal is then blanked at to form the cut-outs 12 and 65 forming the terminal blade portions 8, the current carrying extensions 14 thereof and the further extensions or tabs 18 thereof, and the fuse link portions 20 of fixed reduced thickness dimension. This blanking may be accomplished in one blanking operation as illustrated in FIG. 12 or in a plurality of, for example two, blanking operations. In these blanking operations the transverse web 10' still remains between the terminal blade portions 8 of each blank. Because of the groove 24 shown extending throughout the length of the strip 4' of fuse metal, the transverse web 10' is formed by the reduced thickness portion of the strip, but due to its substantial width it has sufficient rigidity and strength to rigidly support and space the terminal blade portions 8 and current carrying extensions 14 in the strip 4'.

Either before or after an end blank 4'' is severed from the strip, a housing 6 is inserted over the end blank to receive the current carrying extensions 14 and the further extensions or tabs 18 thereof and the fuse link portion 20 within the housing and with the terminal blade portions 8 still interconnected by the transverse web 10' extending from the housing. The housing is then cold staked in the interlock openings 26 of the end blank 4'' as indicated in FIG. 6. Preferably, the placing of the housing 6 over the end blank 4'' and securing the housing to the end blank occurs after severing the end blank from the strip at the blank margin 4'''. In this method the severed end blank 4'' is securely held while the housing is being inserted thereover and being staked thereto. This then forms the substantially completed plug-in fuse assembly, but with the transverse web 10 still intact. The projections 52 which meet within the openings 26 as illustrated in FIG. 6 are then ultrasonically welded together to form a firm connection through the openings 26 between the sides **30*a*–32*a*. Thereafter, the transverse web 10' is stamped out to provide the spaced apart terminal forming blade portions 8 as indicated in FIG. 1. Also thereafter, the ends of the terminal forming blade portions 8 may be coined as illustrated at 9 in FIG. 1 to form tapered ends for the terminal forming blade portions 8**.

Before the blanking operations illustrated in FIG. 12, the strip 4' may be selectively printed at spaced apart intervals therealong in desired selected colors corresponding to desired selected fuse ratings of the plug-in fuse assemblies to be made. The positioning of the printing is such that when the plug-in fuse elements are made, the printing occurs at the current carrying extensions 14 of the plug-in fuse elements 4 and since the housing is transparent such color coding on the plug-in fuse element is visible through the transparent housing. This color coding may be in addition to the fuse rating printed on the top wall 38 of the housing 6.

Since tin does not oxidize when exposed to the atomosphere, the terminal blade portions 8, current carrying extensions 14 and tabs 18 of each plug-in fuse element which are formed from the tin plated portion of the strip 4' will not oxidize, good electrical contact is provided between the terminal forming blade portions and the pressure clip terminals in a mounting panel in which they are received and between the tabs 18 and probes contacting the same.

While the disclosure method of making plug-in fuse elements is the preferred method, many variations may be made therein without deviating from the broader aspects of the invention. For example, while there are many advantages in forming the plug-in fuse elements from a strip of fuse metal where the terminal blade portions of the fuse elements formed therein extend longitudinally of the strip making the location of grooves 24—24' desirably centered in the strip, the present method applies also to the manufacture of plug-in fuse elements where the terminal blade portions of the elements extend transversely of the strip, in which event, the groove 24—24' would be most preferably located along a marginal section of the strip.

I claim:

1. A method of making a plug-in fuse element including a plate-like body of an ambient air oxidizable fuse metal having a pair of spaced confronting generally parallel terminal blade portions to be received by pressure clip terminals or the like, current-carrying extensions at the inner ends of said pair of terminal blade portions and a fuse link portion interconnecting the current-carrying extensions, the method comprising the steps of providing a strip of fuse metal having longitudinally spaced blank portions from which individual plug-in fuse elements are to be formed, each blank portion having corresponding portions spaced transversely of the length of the strip from which said fuse link portions, on the one hand, and at least said terminal blade portions, on the other hand, of a plug-in fuse element is to be formed, providing bands of non-oxidizing conductive coatings on the opposite faces of said fuse metal strip which cover at least the terminal blade-forming portions of said blank portions of said strip, the fuse link-forming portions thereof being free of such coatings, sequentially advancing the strip of fuse metal, and blanking said strip in each of said blank portions thereof to form said pairs of terminal blade portions coated with said conductive non-oxidizing coating, said current-carrying extensions interconnected by a fuse link portion free of said non-oxidizing coatings.

2. The method of claim 1 wherein said strip of fuse metal is selectively provided with said non-oxidizing conductive coatings by masking the fuse link-forming portions thereof while applying said non-oxidizing coatings to the terminal blade-forming portions thereof.

3. The method of claim 1 wherein said strip of fuse metal is selectively provided with said non-oxidizing conductive coatings by initially providing a fuse metal strip which is thicker than desired in the areas thereof from which the fuse link portions of said plug-in fuse elements are to be formed, initially coating all exposed surface areas of said strip and then reducing the thickness of said strip in the fuse link-forming areas thereof to produce thereat fuse metal of said desired thickness and to remove said conductive non-oxidizing coatings therefrom.

4. The method of claim 1 wherein the thickness of said strip is reduced by removing material from both sides thereof.

5. The method of claim 4 wherein the reduction of the thickness of said strip of fuse metal from both sides thereof is provided by forming a continuous longitudinal groove on each side of the strip.

6. The method of claim 5 wherein the strip is reduced in thickness by a relatively small amount on one side thereof so that the exposed metal surface of the strip is adjacent to a flat backing wall during said blanking step and the main reduction in thickness of the strip is obtained primarily by a relatively deep groove formed in the opposite side of the strip.

7. The method of claim 2 wherein said non-oxidizing conductive coating is formed by passing said strip of fuse metal through the bath of a plating tank in a manner which coats all conductive exposed areas thereof with said non-oxidizing coating material, the tank being provided with plating bath isolating means along which the fuse link-forming portions of the strip are passed to isolate such fuse link-forming portions of the strip from the plating bath, to prevent the application thereto of said non-oxidizing coating material.

8. The method of claim 7 wherein said strip of fuse metal is thicker than desired in those areas thereof from which said fuse link portions of the fuse elements are to be formed said isolating means isolating said fuse link-forming portions of the strip on only one side thereof, and said method including the step of removing the plated non-oxidizing conductive coating from the other side of the fuse link-forming portions of the strip by forming a groove therein which reduces the thickness of the fuse link-forming portions thereof of the strip to a desired thickness.

9. The method of claim 7 wherein said isolating means comprises and endless bend of material on at least one side of the strip of fuse metal which band is urged against said strip, said strip of fuse metal and band being moved through the bath of the plating tank in the same direction and at substantially the same speed, to minimize frictional drag therebetween.

10. The method of claim 1 wherein each of said bands of non-oxidizing conductive coatings is a continuous, longitudinal band of said coating extending substantially the length of said strip of fuse metal.

11. The method of claim 1 wherein said terminal blade portions blanked from each blank portion of the strip of fuse metal extend longitudinally of the strip, and said fuse link portions extend generally transversely of the length of the strip.

12. The method of claim 1 wherein the fuse link-formiing portions of the strip are formed by continuous portions of reduced thickness running longitudinally substantially the full length of the strip, so that the fuse link portions of any one of a number of desired shapes, lengths or configurations and/or locations may be formed in each blank portion of the strip at any desired points therealong.

13. The method of claim 12 wherein the terminal blade portions blanked from each blank portion of the strip extends longitudinally of the strip and the fuse link portions blanked therefrom extend generally transversely of the strip, and said bands of non-oxidizing conductive coatings are continuous bands extending longitudinally substantially the full length of the strip on opposite sides of said continuous longitudinally extending portion of reduced thickness, to encompass both the terminal blade-forming portions and the current-carrying extension-forming portions of the strip.

14. The method of claim 1 wherein the non-oxidizing conductive coating on the strip encompasses the current carrying extension-forming portions of the strip as well as the terminal blade-forming portions of the strip

15. A method of making a plug-in fuse element including a plate-like body of an ambient air oxidizable fuse metal having a pair of spaced confronting generally parallel terminal blade portions to be received by pressure clip terminals or the like, current-carrying extensions at the inner ends of said terminal blade portions and a fuse link portion interconnecting the current-carrying extensions, the method comprising the steps of providing a blank of fuse metal having a portion from which the fuse link portion of the fuse element is to be formed and other portions from which said terminal blade portions and current-carrying extensions thereof are to be formed, the blank being thicker than desired in the areas thereof from which said fuse link is to be formed, initially coating all exposed surface areas of said blank with a non-oxidizing conductive coating, and then reducing the thickness of said blank from both sides thereof in the fuse link-forming area thereof, to produce thereat fuse metal of said desired thickness and to remove said conductive non-oxidizing coatings therefrom, and blanking said blank of fuse metal to form a fuse link of desired resistance value from said reduced thickness fuse link-forming portions of the blank and to form said terminal blade portions and current-carrying extensions thereof in the other portions of the blank.

16. The method of claim 13 wherein the blank is reduced in thickness by a relatively small amount on one side thereof so that the exposed metal surface of the blank is contiguous to a flat backing wall during said blanking step and the main reduction in thickness of the blank is obtained primarily by a relatively deep groove formed in the opposite side of the blank.

* * * * *